US005356046A

United States Patent [19]

Burke

[11] Patent Number: 5,356,046

[45] Date of Patent: Oct. 18, 1994

[54] COVER FOR BOTTLED WATER DISPENSER

[76] Inventor: Melissa Burke, 27728 SW. 132 Ct., Miami, Fla. 33032

[21] Appl. No.: 608,060

[22] Filed: Nov. 1, 1990

[51] Int. Cl.[5] ..... B67D 5/38

[52] U.S. Cl. ..... 222/156; 150/154; 222/183; 222/185; 383/106

[58] Field of Search ..... 222/131, 154, 156, 158, 222/183, 185; 150/154; 215/11.6, 100 R; 383/106

[56] References Cited

U.S. PATENT DOCUMENTS

| | | | |
|---|---|---|---|
| 1,375,480 | 4/1921 | West | 150/154 |
| 2,025,796 | 12/1935 | Waldheim | 222/183 |
| 2,447,561 | 8/1948 | Brenner | 383/106 X |
| 2,731,999 | 1/1956 | Burns | 150/154 |
| 3,332,563 | 7/1967 | Reshan | 215/11.6 X |
| 4,244,411 | 1/1981 | Kartström | 150/154 |
| 4,293,082 | 10/1981 | Matsueda | 222/131 |
| 4,834,250 | 4/1989 | Dumbeck et al. | 222/185 X |
| 4,844,286 | 7/1989 | Jacobson | 150/154 X |

*Primary Examiner*—Andres Kashnikow
*Assistant Examiner*—Joseph A. Kaufman
*Attorney, Agent, or Firm*—J. Sanchelima

[57] ABSTRACT

A cover for bottled water dispenser having a water bottle mounted on top and at least one water outlet valved for dispensing the water. An upper cover portion made out of a flexible and opaque material with the shape of a sac with cooperative dimensions for receiving and covering the water bottle and the sac having an opening and a string for closing the opening of the sac against the neck of the bottle. A lower cover portion made out of a flexible sheet having a substantially rectangular shape that cooperatively covers the dispenser and elastic strings or laces for keeping said lower cover portion mounted to said dispenser and said lower cover portion further including an opening exposing said water outlet valves.

6 Claims, 1 Drawing Sheet

COVER FOR BOTTLED WATER DISPENSER

BACKGROUND OF THE INVENTION

1. Field of the Invention

The present invention relates to cover devices for bottled water dispensers.

2. Description of the Related Art

Bottled water devices typically provide a sight with poor aesthetics and not infrequently these devices collect dust and other matter floating in the environment. Users gathering around these devices not infrequently lean against it or in other ways touch it thereby increasing the chances for the transmission of diseases. Also, microorganisms' development is minimized when the bottled water is not exposed to sunlight.

There has been no prior cover for bottled water dispensers designed to fulfill the functions of the one claimed here, including its ready mounting to existing water dispensing apparatus, with the added aesthetics and space for advertising announcements.

SUMMARY OF THE INVENTION

It is one of the main objects of the present invention to provide a cover for bottled water dispensers that can be readily installed in most of the existing designs for such dispensers and that can effectively prevent users from coming in contact with it and to prevent the bottled water from exposure to sunlight.

It is another object of this invention to provide such a cover that includes sufficient space that is suitable for the placing of advertising or sponsor's messages.

It is still another object of this invention to provide such a cover that can still readily show the amount of water left in the bottle.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
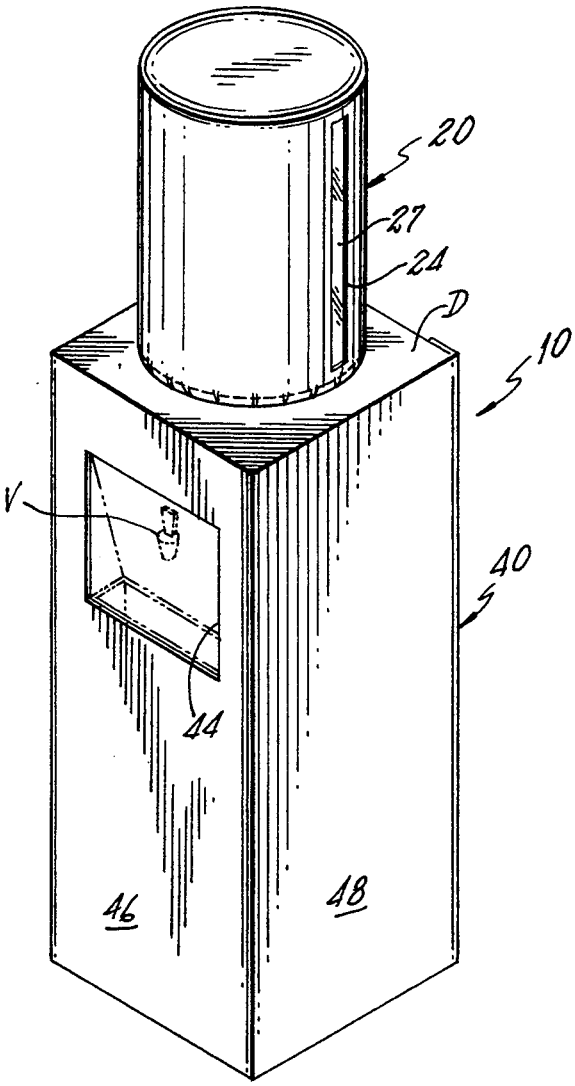
FIG. 1 represents an isometric view of the cover subject of the present application mounted over a bottled water dispenser.
Figure 2:
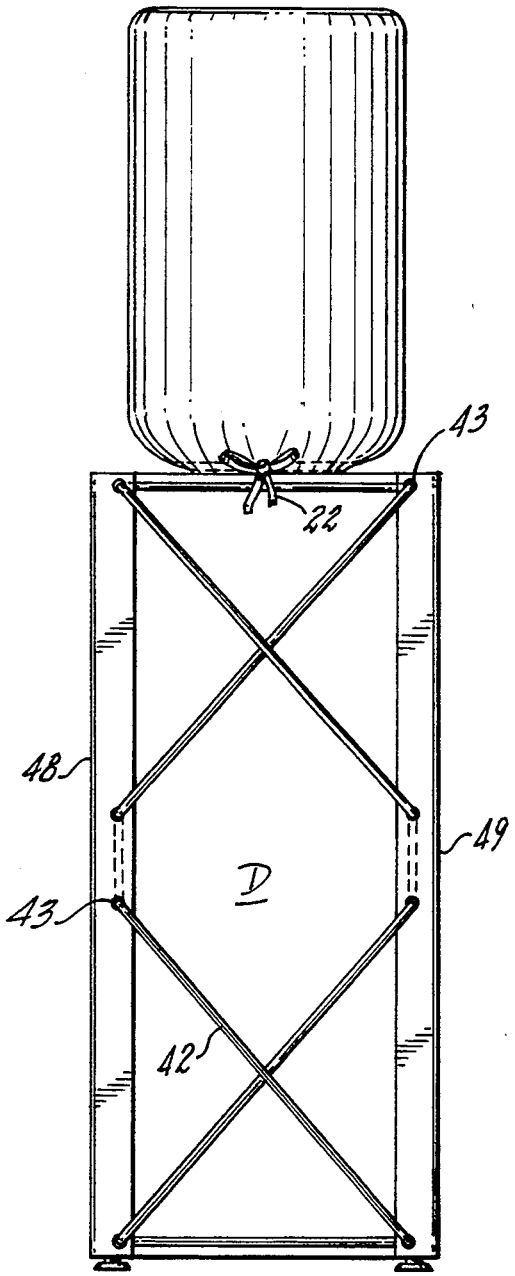
FIG. 2 shows a rear elevational view of a water dispenser and bottle wherein the present invention has been installed.

Referring now to FIG. 1, where the present invention is generally referred to with numeral 10, it can be observed that it basically includes upper cover portion 20 and lower cover portion 40 and these two portions cover substantially the entire structure of the dispenser and bottle that it holds. Upper cover portion 20 is made out of an opaque material that prevents the sun light to penetrate thereby protecting the water inside the bottle.

Upper portion 20 has substantially the shape of a cylindrical sac with cord member 22 at its opening. It is also possible to use an elastic member or any other equivalent means for adjusting the opening to fittingly follow the neck of the bottle being covered. Longitudinal slot 24 is provided to permit a user to see the amount of water left in the bottle in order to determine whether replacement i s required.

Lower portion 40 has substantially a rectangular shape that cooperatively follows the shape of a typical bottled water dispenser D and it includes elastic cord members 42 in the back that permit a snug fit around dispenser D. Openings 43 permit cord member 42 through in criss-crossed arrangement in the preferred embodiment. Opening 44 is provided at the front of dispenser D for ready access to the water outlet valves V of dispenser D.

Side areas 46, 48 and 49 are suitable for the display of any advertising or message. The same is true for most of the surface of upper portion 20 which is only interrupted by longitudinal slot 24 that serves the purpose of permitting users to determine the amount of water left in the bottle and can be seen through the transparent window 27 that is preferably made out of a transparent flexible plastic material.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense

What is claimed is:

1. A cover for bottled water dispensers having a water bottle mounted thereon and at least one water outlet valve, comprising:

A. upper cover portion made out of a flexible and opaque material having substantially the shape of a sac with cooperative dimensions for receiving and covering said water bottle and said sac having an opening and further including means for closing the opening of said sac opening to fittingly come in contact with the neck of said bottle;

B. lower cover portion being made out of a flexible sheet having substantially a rectangular shape that cooperatively covers substantially said dispenser and means for keeping said lower cover portion mounted to said dispenser and said lower cover portion further including an opening exposing said water outlet valves.

2. The cover for bottled water set forth in claim 1 wherein said upper cover portion further includes a longitudinal slot that exposes the level of water left inside said bottle.

3. The cover for bottled water set forth in claim 2 wherein said longitudinal slot is covered with a transparent material.

4. The cover for bottled water set forth in claim 3 wherein said transparent material is flexible.

5. The cover for bottled water set forth in claim 4 wherein said transparent material and flexible material is made out of plastic.

6. The cover for bottled water set forth in claim 5 wherein said upper and lower portions include sufficiently large areas for affixing messages and advertising information.

* * * * *